US007946823B2

(12) United States Patent
Mujezinovic et al.

(10) Patent No.: US 7,946,823 B2
(45) **Date of Patent: *May 24, 2011**

(54) STEAM TURBINE ROTATING BLADE

(75) Inventors: Amir Mujezinovic, Schenectady, NY (US); Jonathon Slepski, Clifton Park, NY (US); Steven DeLessio, Saratoga Springs, NY (US)

(73) Assignee: Nuovo Pignone Holdings, S.p.A., Florence (IT)

( * ) Notice: Subject to any disclaimer, the term of this patent is extended or adjusted under 35 U.S.C. 154(b) by 980 days.

This patent is subject to a terminal disclaimer.

(21) Appl. No.: 11/778,187

(22) Filed: Jul. 16, 2007

(65) Prior Publication Data

US 2010/0021306 A1 Jan. 28, 2010

(51) Int. Cl.
*F01D 5/22* (2006.01)

(52) U.S. Cl. ..... 416/191

(58) Field of Classification Search ..... 415/191
See application file for complete search history.

(56) References Cited

U.S. PATENT DOCUMENTS

| | | | | |
|---|---|---|---|---|
| 5,267,834 | A | 12/1993 | Dinh et al. | |
| 5,277,549 | A | 1/1994 | Chen et al. | |
| 5,480,285 | A | 1/1996 | Patel et al. | |
| 5,509,784 | A * | 4/1996 | Caruso et al. | 416/190 |
| 6,575,700 | B2 | 6/2003 | Arai et al. | |
| 6,814,543 | B2 | 11/2004 | Barb et al. | |
| 7,097,428 | B2 | 8/2006 | Barb et al. | |

* cited by examiner

*Primary Examiner* — Richard Edgar
(74) *Attorney, Agent, or Firm* — Nixon & Vanderhye P.C.

(57) ABSTRACT

A rotating blade for a steam turbine includes a root section and an airfoil section contiguous with the root section. The airfoil section is shaped to optimize aerodynamic performance while providing optimized flow distribution and minimal centrifugal and bending stresses. The blade also includes a tip section continuous with the airfoil section, and a cover formed as part of the tip section. The cover defines a radial seal that serves to minimize tip losses. The rotating blade is capable of running at operating speeds between 5626 and 11250 rotations per minute.

15 Claims, 3 Drawing Sheets

STEAM TURBINE ROTATING BLADE

BACKGROUND OF THE INVENTION

The present invention relates to a rotating blade for a steam turbine and, more particularly, to a rotating blade for a steam turbine with optimized geometry capable of increased operating speeds.

The steam flow path of a steam turbine is formed by a stationary cylinder and a rotor. A number of stationary vanes are attached to the cylinder in a circumferential array and extend inward into the steam flow path. Similarly, a number of rotating blades are attached to the rotor in a circumferential array and extend outward into the steam flow path. The stationary vanes and rotating blades are arranged in alternating rows so that a row of vanes and the immediately downstream row of blades form a stage. The vanes serve to direct the flow of steam so that it enters the downstream row of blades at the correct angle. The blade airfoils extract energy from the steam, thereby developing the power necessary to drive the rotor and the load attached to it.

The amount of energy extracted by each row of rotating blades depends on the size and shape of the blade airfoils, as well as the quantity of blades in the row. Thus, the shapes of the blade airfoils are an important factor in the thermodynamic performance of the turbine, and determining the geometry of the blade airfoils is an important portion of the turbine design.

As the steam flows through the turbine, its pressure drops through each succeeding stage until the desired discharge pressure is achieved. Thus, the steam properties—that is, temperature, pressure, velocity and moisture content—vary from row to row as the steam expands through the flow path. Consequently, each blade row employs blades having an airfoil shape that is optimized for the steam conditions associated with that row. However, within a given row, the blade airfoil shapes are identical, except in certain turbines in which the airfoil shapes are varied among the blades within the row in order to vary the resonant frequencies.

The blade airfoils extend from a blade root used to secure the blade to the rotor. Conventionally, this is accomplished by imparting a fir tree shape to the root by forming approximately axially extending alternating tangs and grooves along the sides of the blade root. Slots having mating tangs and grooves are formed in the rotor disc. When the blade root is slid into the disc slot, the centrifugal load on the blade, which is very high due to the high rotational speed of the rotor, is distributed along portions of the tangs over which the root and disc are in contact. Because of the high centrifugal loading, the stresses in the blade root and disc slot are very high. It is important, therefore, to minimize the stress concentrations formed by the tangs and grooves and maximize the bearing areas over which the contact forces between the blade root and disc slot occur. This is especially important in the latter rows of a low pressure steam turbine due to the large size and weight of the blades in these rows and the presence of stress corrosion due to moisture in the steam flow.

In addition to the steady centrifugal loading, the blades are also subject to vibration.

The low pressure section rotating turbine blades are typically designed and optimized to cover a given operating speed as required by the different applications. Main operating parameters are annulus area, rotating speed, mass flow capability, and for the last stage blade, condensing pressure.

The difficulty associated with designing a steam turbine blade is exacerbated by the fact that the airfoil shape determines, in large part, both the forces imposed on the blade and its mechanical strength and resonant frequencies, as well as the thermodynamic performance of the blade. These considerations impose constraints on the choice of blade airfoil shape so that, of necessity, the optimum blade airfoil shape for a given row is a matter of compromise between its mechanical and aerodynamic properties.

It is therefore desirable to provide a row of steam turbine blades that provides good thermodynamic performance while minimizing the stresses on the blade airfoil and root due to centrifugal force and avoiding resonant excitation.

BRIEF DESCRIPTION OF THE INVENTION

In an exemplary embodiment, a rotating blade for a steam turbine includes a root section and an airfoil section contiguous with the root section. The airfoil section is shaped to optimize aerodynamic performance while providing optimized flow distribution and minimal centrifugal and bending stresses. The blade also includes a tip section continuous with the airfoil section, and a cover formed as part of the tip section. The cover defines a radial seal that serves to minimize tip losses.

In another exemplary embodiment, a rotating blade for a steam turbine includes a root section and an airfoil section contiguous with the root section. The airfoil section is shaped to optimize aerodynamic performance while providing optimized flow distribution and minimal centrifugal and bending stresses. The blade also includes a tip section continuous with the airfoil section and having a tip width, and a cover formed as part of the tip section. The cover is wider than the tip width such that at speed, the cover engages an adjacent cover of an adjacent blade. The cover also defines a radial seal that serves to minimize tip losses. The blade is configured such that an exit annulus area of the blade is 0.461 $m^2$, an operating speed range of the blade is between 5625 and 11250 rotations per minute, and a maximum mass flow of the blade is 30.9 kg/s.

DETAILED DESCRIPTION OF THE INVENTION

Figure 1:
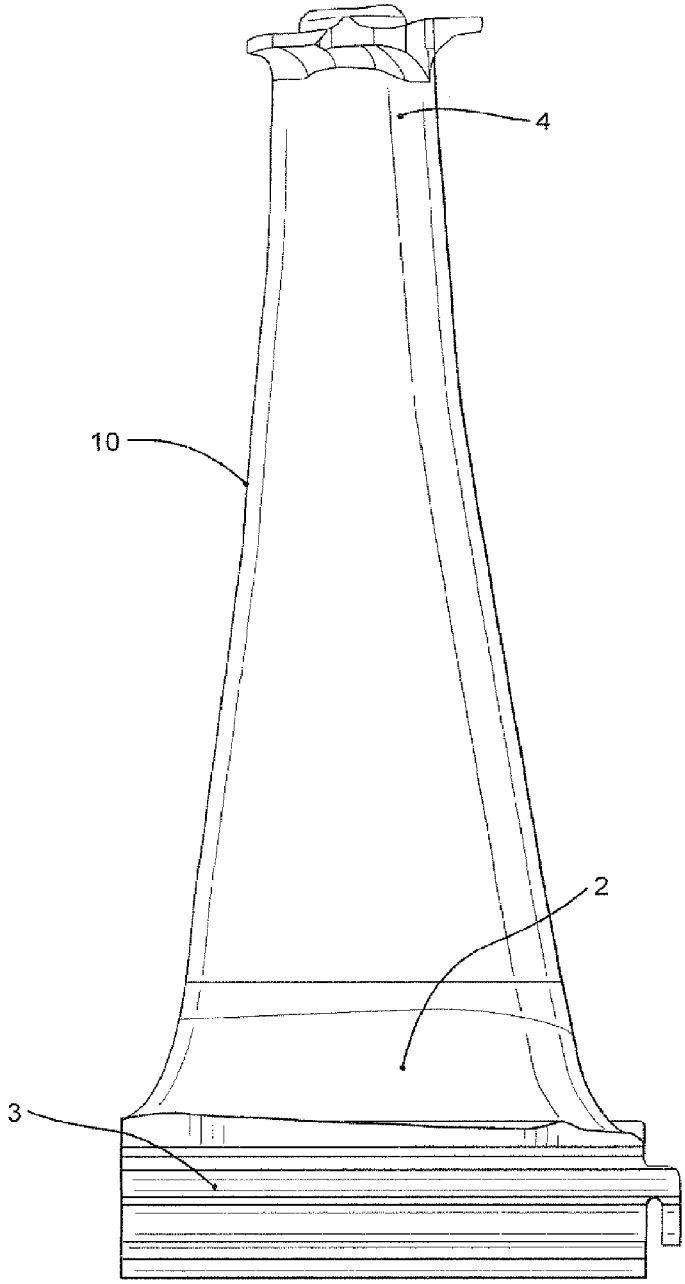
FIG. 1 is a front view of the steam turbine rotating blade.
Figure 2:
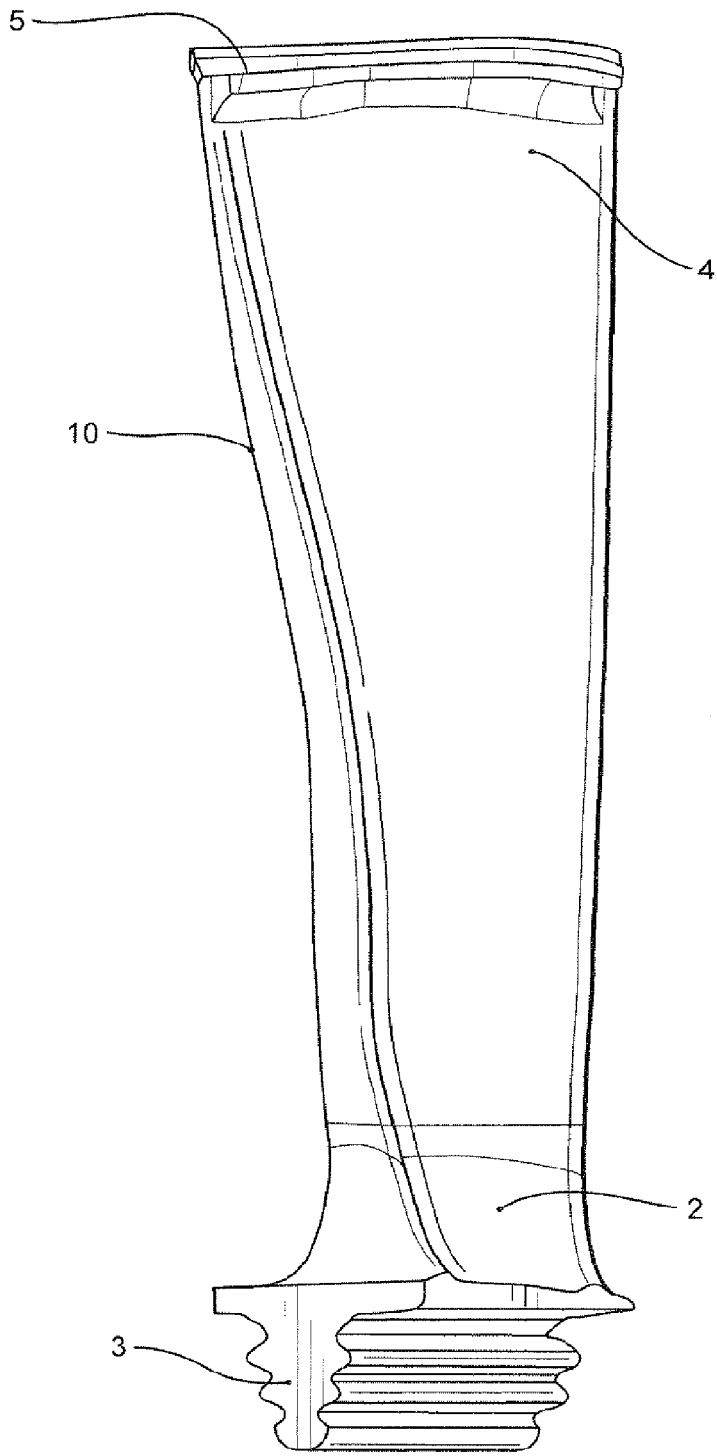
FIG. 2 is a perspective view.

With reference to FIGS. 1 and 2, a rotating blade for a steam turbine includes a root section 2 connected to an axial entry dovetail 3 for connection to the turbine rotor. As shown, the dovetail 3 includes a two-hook fir tree shape. The subject of a co-pending U.S. patent application, the axial entry dovetail geometry has been optimized to obtain a distribution of average and local stress that guarantees adequate protection for over-speed and LCF (low cycle fatigue) margins.

Figure 3:
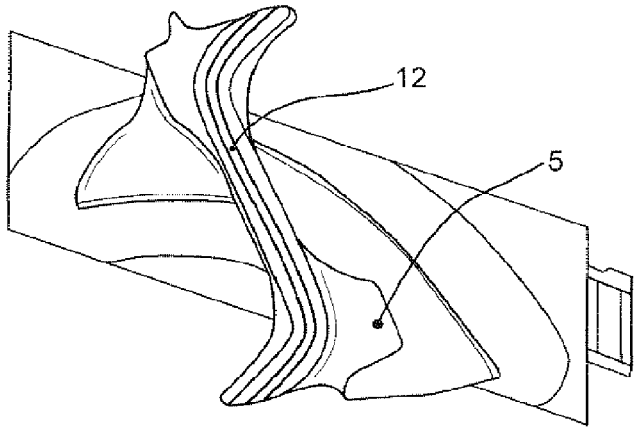
FIG. 3 is a top view of the blade cover.
Figure 4:
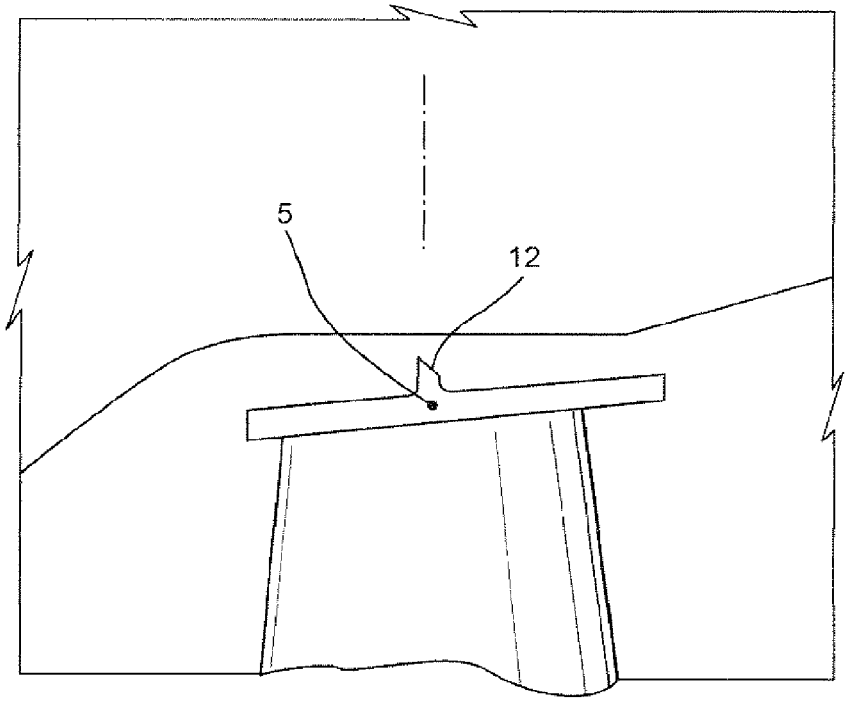
FIG. 4 shows the blade tip and cover.

An airfoil 10 extends from the root section 2, and a tip section 4 is continuous with the airfoil section 10. As shown in FIGS. 3 and 4, a cover 5 is formed as part of the tip section 4.

In order to accommodate operating speeds that range from 5625 to 11250 rotations per minute with a maximum mass flow of 30.9 kg/s and an exit annulus area of 0.461 $m^2$, computational fluid dynamics were performed in order to optimize airfoil geometry. Mass flow and annulus area are important design parameters as is appreciated by those of ordinary skill in the art. An "exit annulus area" is an area of annular shape formed on the bottom by the top of the blade dovetail and on the top by the underside of the cover. The optimized geometry can accommodate the higher operating speeds while avoiding associated increases in stress and frequency concerns. In particular, the airfoil section 10 is provided with an optimal pitch to width ratio. Moreover, a thickness distribution along the airfoil section 10 is modified from a convention construction to optimize performance. Still further, the curvature of the airfoil section 10 is adjusted to lower pressure and shock losses as a result of the high speed operation. Stacking of airfoil sections is optimized to minimize vane root local stress caused by the centrifugal twist of the blade.

FIGS. 3 and 4 show the blade cover 5 in top and lateral views, respectively. The cover 5 is preferably machined with the blade and is thus integral with the tip section 4. The cover 5 includes at least one, preferably two, tip seals 12 and cylindrical surfaces machined on the blade to provide leakage control.

As shown in FIG. 4, the cover 5 is constructed in a wider width than a width of the tip section 4. This construction along with a twist in the blade defines an initial gap between cover contact faces of adjacent blades. This gap is closed at speed as a consequence of the cover rotation caused by the untwist of the blade. Once the covers of adjacent blades engage one another, the blades behave like a single continuously coupled structure that exhibits a superior stiffness and damping characteristics when compared to a free-standing design, leading to very low vibratory stresses. That is, the engaged covers between adjacent blades form a cover band or shroud around the outer periphery of the turbine wheel to confine the working fluid within a well-defined path and to increase the rigidity of the blades.

The steam turbine rotating blade described herein affords significantly enhanced aerodynamic and mechanical performance and efficiencies while also including covers having radial sealing to minimize tip losses, minimal centrifugal and steam bending stresses, a continuously coupled cover design to minimize vibratory stresses, reduced efficiency losses, and optimized flow distribution. As such, the turbine blades can be run efficiently at higher operating speeds.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A rotating blade for a steam turbine comprising:

a root section;

an airfoil section contiguous with the root section, the airfoil section being shaped to optimize aerodynamic performance while providing optimized flow distribution and minimal centrifugal and bending stresses;

a tip section continuous with the airfoil section; and a cover formed as part of the tip section, the cover defining a radial seal that minimizes tip losses, wherein an exit annulus area of the rotating blade is 0.461 $m^2$.

2. A rotating blade according to claim 1, wherein an operating speed range of the blade is between 5625 and 11250 rotations per minute.

3. A rotating blade according to claim 2, comprising a maximum mass flow of 30.9 kg/s.

4. A rotating blade according to claim 1, wherein an operating speed range of the blade is between 5625 and 11250 rotations per minute.

5. A rotating blade according to claim 1, wherein the blade is designed for operation as a last stage blade.

6. A rotating blade according to claim 5, wherein the cover is sized such that at speed, the cover engages an adjacent cover of an adjacent blade.

7. A rotating blade according to claim 6, wherein the cover is integral with the tip section.

8. A rotating blade according to claim 1, wherein the cover is integral with the tip section.

9. A rotating blade according to claim 1, wherein the radial seal comprises at least one tip seal.

10. A rotating blade for a steam turbine comprising:

a root section;

an airfoil section contiguous with the root section, the airfoil section being shaped to optimize aerodynamic performance while providing optimized flow distribution and minimal centrifugal and bending stresses;

a tip section continuous with the airfoil section and having a tip width; and a cover formed as part of the tip section, the cover defining a radial seal that minimizes tip losses, wherein the cover is wider than the tip width such that at speed, the cover engages an adjacent cover of an adjacent blade, and wherein an exit annulus area of the blade is 0.461 $m^2$, an operating speed range of the blade is between 5625 and 11250 rotations per minute, and a maximum mass flow of the blade is 30.9 kg/s.

11. A rotating blade according to claim 10, wherein the airfoil section comprises an optimal pitch to width ratio.

12. A rotating blade according to claim 10, wherein a thickness distribution of the airfoil section is configured to optimize blade speed capabilities and resistance to low cycle fatigue.

13. A rotating blade according to claim 10, wherein the airfoil section comprises a curvature that lowers pressure losses and shock losses.

14. A rotating blade according to claim 10, wherein the airfoil section is twisted such that at rest, there is a gap between the cover and a cover of an adjacent blade, and wherein at speed, the airfoil section is configured to untwist such that the cover engages the cover of the adjacent blade.

15. A rotating blade according to claim 10, wherein the blade is formed of M152 steel.

* * * * *